US010927800B2

(12) United States Patent
Jean et al.

(10) Patent No.: US 10,927,800 B2
(45) Date of Patent: Feb. 23, 2021

(54) DEVICE FOR ATTENUATING INTAKE NOISE AND RADIATED NOISE

(71) Applicant: NOVARES FRANCE, Clamart (FR)

(72) Inventors: Thomas Jean, Houdain (FR); Aurelien Lorenski, Fillievres (FR)

(73) Assignee: NOVARES FRANCE, Clamart (FR)

( * ) Notice: Subject to any disclaimer, the term of this patent is extended or adjusted under 35 U.S.C. 154(b) by 436 days.

(21) Appl. No.: 15/578,112

(22) PCT Filed: May 27, 2016

(86) PCT No.: PCT/FR2016/051256
§ 371 (c)(1),
(2) Date: Nov. 29, 2017

(87) PCT Pub. No.: WO2016/193584
PCT Pub. Date: Dec. 8, 2016

(65) Prior Publication Data

US 2018/0156172 A1 Jun. 7, 2018

(30) Foreign Application Priority Data

May 29, 2015 (FR) ..... 15/54916

(51) Int. Cl.
*F02M 35/12* (2006.01)

(52) U.S. Cl.
CPC .... *F02M 35/1266* (2013.01); *F02M 35/1216* (2013.01); *F02M 35/1233* (2013.01);
(Continued)

(58) Field of Classification Search
CPC ..... F02M 35/1216; F02M 35/1233; F02M 35/1272; F02M 35/1211; F02M 35/1266
(Continued)

(56) References Cited

U.S. PATENT DOCUMENTS 2,056,608 A * 10/1936 William ..... F01N 1/006 181/248
2,166,417 A 7/1939 Manning
(Continued)

FOREIGN PATENT DOCUMENTS

| | | | |
|---|---|---|---|
| DE | 102007039048 | A1 | 2/2009 |
| EP | 1043494 | A2 | 10/2000 |
| WO | 02101227 | A1 | 12/2002 |

OTHER PUBLICATIONS

DE102007039048 English Translation of Abstract.
(Continued)

*Primary Examiner* — Forrest M Phillips
(74) *Attorney, Agent, or Firm* — Cantor Colburn LLP

(57) ABSTRACT

The invention concerns a device (1) for attenuating intake noise and radiated noise that comprises an internal gas delivery conduit (2) linked to a combustion engine, the conduit (2) having a peripheral wall (23) on at least one portion of which there is disposed at least one element porous to air (4), sound attenuation means comprising at least one tube (3) disposed in the delivery conduit, at least one peripheral chamber (5) being delimited inside the conduit (2) between the tube (3) and the peripheral wall (23) of the conduit (2), the tube (3) comprising at least one portion having an opening (30) allowing the inside of the tube (3) to communicate with the peripheral chamber (5).

3 Claims, 3 Drawing Sheets

(52) U.S. Cl.
CPC ..... *F02M 35/1272* (2013.01); *F02M 35/1211* (2013.01); *F02M 35/1277* (2013.01)

(58) Field of Classification Search
USPC ..... 181/214, 257; 123/184.54, 184.53, 123/184.57
See application file for complete search history.

(56) References Cited

U.S. PATENT DOCUMENTS

| | | | | |
|---|---|---|---|---|
| 7,556,123 | B2 * | 7/2009 | Ido | F01N 1/023 123/184.57 |
| 7,934,581 | B2 * | 5/2011 | Kim | F04D 29/665 181/250 |
| 7,967,106 | B2 * | 6/2011 | Ross | F02M 35/1266 123/184.53 |
| 2015/0107935 | A1 * | 4/2015 | Dobrin | F02M 35/1261 181/214 |
| 2015/0226163 | A1 * | 8/2015 | Hwang | F02M 35/1255 181/214 |
| 2016/0061075 | A1 * | 3/2016 | Kimura | F04B 39/0061 181/229 |
| 2016/0201531 | A1 * | 7/2016 | Fletcher | F02M 35/1211 181/252 |

OTHER PUBLICATIONS

EP1043494 English Translation of Abstract.
International Search Report for Application No. PCT/FR2016/051256.

* cited by examiner

DEVICE FOR ATTENUATING INTAKE NOISE AND RADIATED NOISE

CROSS REFERENCE TO RELATED APPLICATIONS

This application is a National Stage of PCT Application No. PCT/FR2016/051256 filed on May 27, 2016, which claims priority to French Patent Application No. 15/54916 filed on May 29, 2015, the contents each of which are incorporated herein by reference thereto.

TECHNICAL FIELD

The present invention concerns a device for attenuating suction noises and radiated noises, comprising a gas delivery conduit connected to an internal combustion engine.

BACKGROUND

It is known that internal combustion engines have a low-frequency acoustic component ranging from 30 Hz to 1 kHz. This acoustic component is generated by the periodic opening and closure of the valves, as well as by the resonances of the different cavities of the engine (combustion chambers, conduits . . . ). The low-frequency acoustic component propagates and is radiated at the entrance of the air supply circuit of the engine. By propagating inside the air supply conduits of the engine, the low-frequency acoustic component excites the resonance of the conduits, which generates considerable acoustic emissions.

Furthermore, in the case of turbocharged engines, there is a high-frequency acoustic component ranging from 1 kHz to 15 kHz. This acoustic component is generated by the turbocharger and may also propagate and radiate through the air supply conduits.

Conventionally, suction noise means the acoustic component which propagates in the air supply conduits, and radiated noise means the acoustic component radiated by the air supply conduits.

Currently, in order to attenuate the noises coming from the air intake conduits, it is known to use a silencer. A silencer usually has a central tube in which air coming from the turbocharger circulates, and whose wall is perforated with several orifices which put the inside of the tube in communication with a peripheral chamber, delimited by a bell which surrounds the central tube. When it is stimulated by sound waves, the small volume of air contained in each orifice substantially acts as a little mass, which would be suspended to a spring constituted by the more considerable volume of air contained in the peripheral chamber. Thus, an attenuation of the noise in a spectral band located in the vicinity of the characteristic frequency of this «mass-spring» system is achieved.

However, the silencer cannot cover the entire frequency range. Indeed, the silencer has not a sufficient attenuation level in the low-frequencies range.

Another solution consists in using a resonator. The resonator comprises a central tube having a closed bypass at a right angle. This type of resonator is very selective and operates only over a very thin frequency band.

BRIEF SUMMARY

Consequently, an object of the present invention is to propose a device for attenuating suction noises and radiated noises, allowing covering a wide range of frequencies, still without requiring a significant volume.

According to a general definition, the invention concerns a device for attenuating suction noises and radiated noises, which comprises a gas delivery conduit intended to be connected to a combustion engine. The conduit has a peripheral wall over at least one portion of which is disposed at least one air-porous element, sound attenuating means which comprise at least one tube disposed in the delivery conduit. At least one peripheral chamber is delimited inside the conduit between the tube and the peripheral wall of the conduit. The tube comprises at least one portion having an orifice which enables the inside of the tube to communicate with the peripheral chamber.

The synergy of the porous element arranged on the peripheral wall with the tube having at least one orifice enables the device according to the invention to attenuate the suction noises and the radiated noises, over a wider frequency range. In addition, the combination of the porous element disposed on the peripheral wall with the tube having at least one orifice allows the device according to the invention to be barely voluminous. Indeed, the porous element allows attenuating the sound waves over certain frequencies, which allows avoiding a long succession of orifices on the tube to cover a wide frequency range.

Thus, the invention proposes a device for attenuating suction noises and radiated noises, allowing covering a wide range of frequencies, still without requiring a significant volume.

Furthermore, in comparison with the air supply conduits of the prior art, the device according to the invention advantageously allows reducing the ingestion of hot air by the engine.

The conduit may have at least one substantially transverse inner partition wall positioned around the tube and allowing delimiting at least two compartments of the peripheral chamber.

In one embodiment, at least one portion of the tube surrounded by one of the compartments may have a plurality of orifices so that said tube portion and the corresponding compartment form an absorption silencer.

In another embodiment, at least one portion of the tube surrounded by one of the compartments may have an orifice so that said tube portion and the corresponding compartment form a resonator.

In another embodiment, at least one portion of the tube surrounded by any of the compartments may have two diametrically opposed orifices so that said tube portion and the corresponding compartment form an expansion chamber of the gas circulating in the tube.

According to a particular arrangement, the device may have at least three successive portions forming absorption silencers, at least one portion forming an expansion chamber and at least one portion forming a resonator.

Thus, the device according to the invention advantageously allows combining the effects of the absorption silencers, of the resonator and of the air-porous element.

The air-porous element may have at least one strip made of air-porous material.

According to one embodiment, the device may comprise at least two diametrically opposed air-porous elements on the peripheral wall of the conduit.

BRIEF DESCRIPTION OF THE DRAWINGS

Other features and advantages of the present invention will emerge from the following description, with reference to the appended drawings which represent an embodiment of the invention.

DETAILED DESCRIPTION

Figure 1:
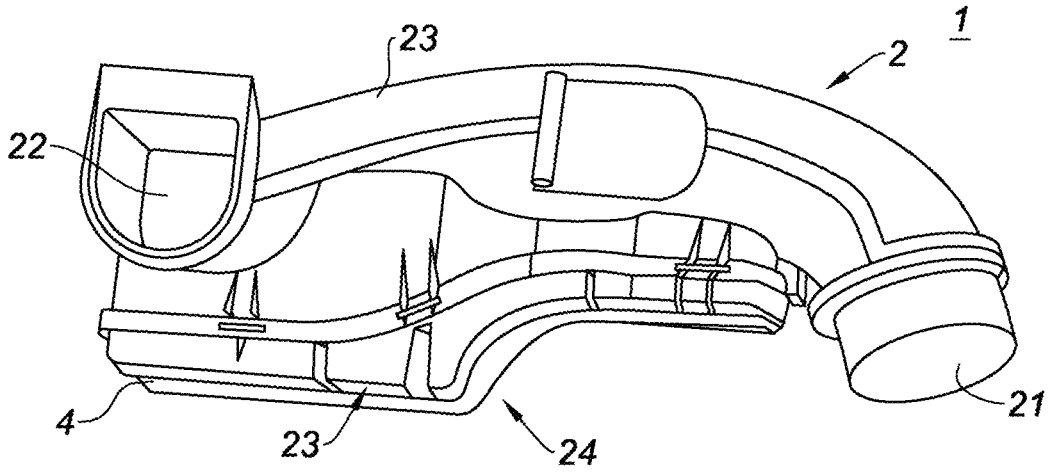
FIG. 1 is a perspective view of a device according to the invention.
Figure 2:
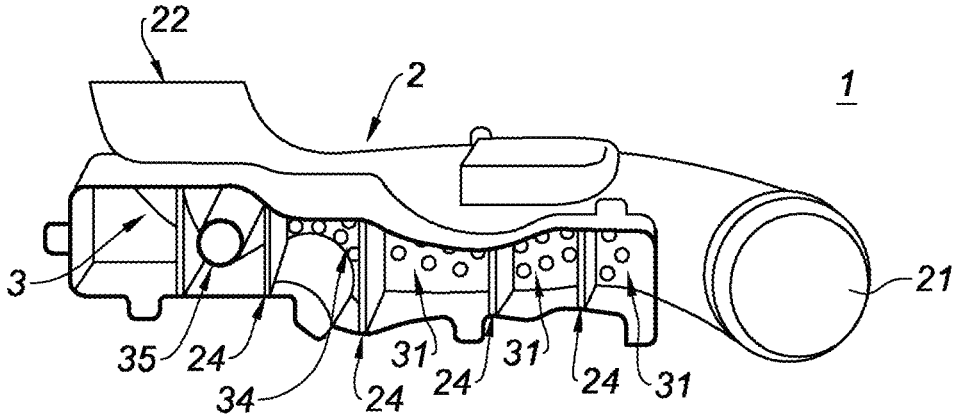
FIG. 2 is a partial sectional perspective view of a device according to the invention.

Referring to FIGS. 1 and 2, the device 1 comprises an air intake conduit 2 configured to be connected to an internal combustion engine of a vehicle (not shown). The conduit 2 has two ends 21-22 and a peripheral wall 23. In addition, according to the example herein described, the conduit 2 has a substantially parallelepipedic protrusion 24.

According to the embodiment herein described, the conduit 2 is made from two shells molded by injection and then assembled by their edges according to a welding process.

Figure 4:
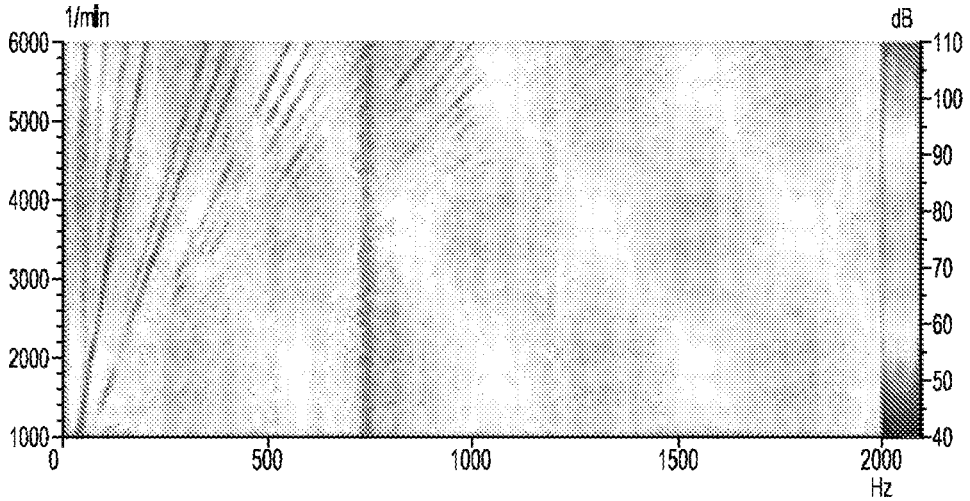
FIG. 4 is a graph showing the suction noise level and the frequency range of the suction noise emitted by an air intake conduit devoid of any noise attenuating member.

As observed in FIGS. 1 and 4, a strip of an air-porous material 4 is disposed against a portion of the wall 23.

According to the example herein described, the air-porous element may be an acrylic impregnated fibrous material.

Figure 3:
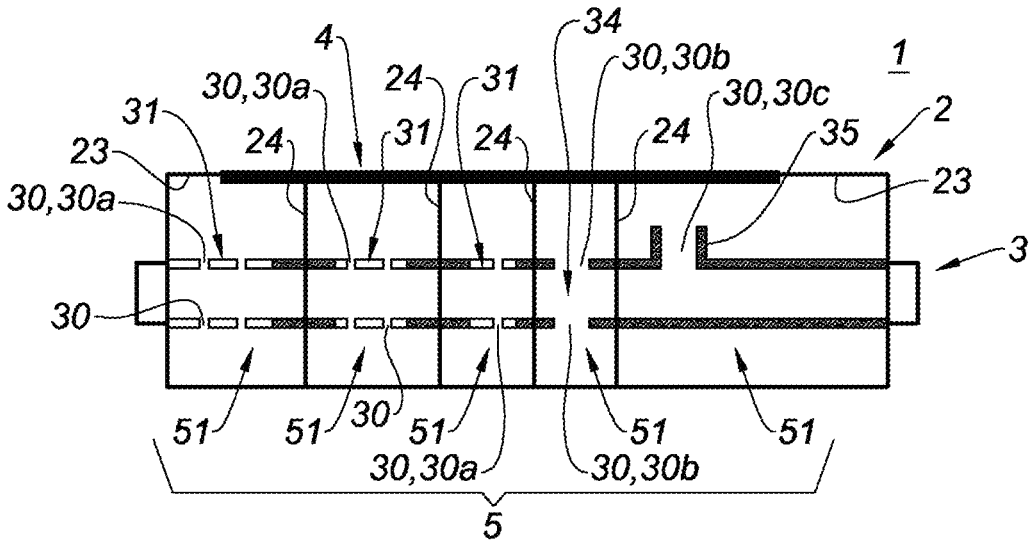
FIG. 3 is a schematic sectional view of a device according to the invention.

Referring to FIGS. 2 and 3, the conduit 2 comprises a tube 3.

The space between the outside of the tube 3 and the peripheral wall 23 defines a chamber 5. Transverse inner partition walls 24 divide the chamber 5 into several compartments 51.

Moreover, it should be noted that different portions of the tube 3, each surrounded by a different compartment 51, have several orifices 30 with different geometries.

According to the embodiment shown in FIGS. 2 and 3, the tube 3 has three portions each having several orifices 30*a* to form, with the corresponding compartment 51, an absorption silencer 31. In a particularly advantageous manner, each of the three absorption silencers 31 may be calibrated to attenuate a distinct frequency range.

According to the embodiment herein described, another portion of the tube 3 surrounded by a compartment 51 may have two diametrically opposed orifices 30*b* so as to form an expansion chamber of the gases circulating in the tube 3.

Moreover, it should be noted that another portion of the tube 3 surrounded by a compartment 51 may have a bypass at a right angle comprising an orifice 30*c*, to form a resonator 35.

During usage, the advantageous combination of the three silencers 31, of the expansion chamber 34, of the resonator 35 and of the air-porous element 4, allows the device 1 to attenuate the suction noises and the radiated noises over a wide frequency range.

Indeed, as shown in the graph represented in FIG. 4, an air intake conduit without a sound attenuating device emits a high level of suction noise over a wide frequency range.

Figure 5:
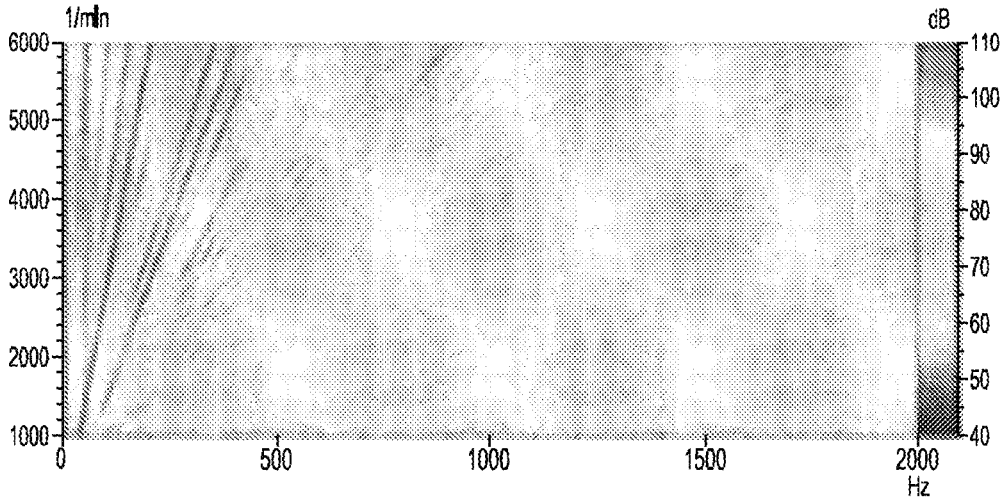
FIG. 5 is a graph showing the suction noise level and the frequency range of the suction noise emitted by an air intake conduit having several silencers.

In comparison with the graph represented in FIG. 5, an air intake conduit having several silencers allows attenuating the high-frequency sound emissions but have little effect on the low frequencies.

Figure 6:
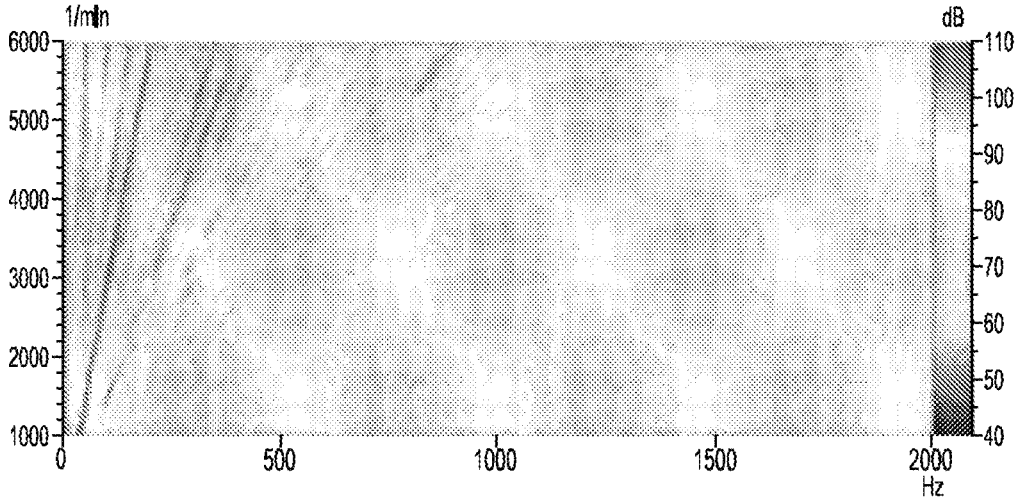
FIG. 6 is a graph showing the suction noise level and the frequency range of the suction noise emitted by a device according to the invention.

In contrast, as it can be noted in the graph represented in FIG. 6, the device 1 according to the invention allows attenuating substantially all the sound frequencies of the emitted suction noises.

Figure 7:
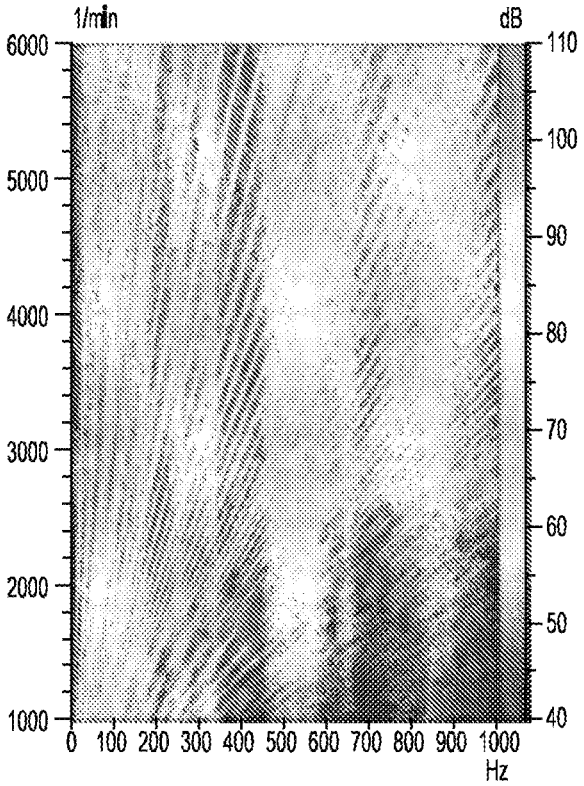
FIG. 7 is a graph showing the radiated noise level and the frequency range of the radiated noise emitted by an air intake conduit having a porous element.
Figure 8:
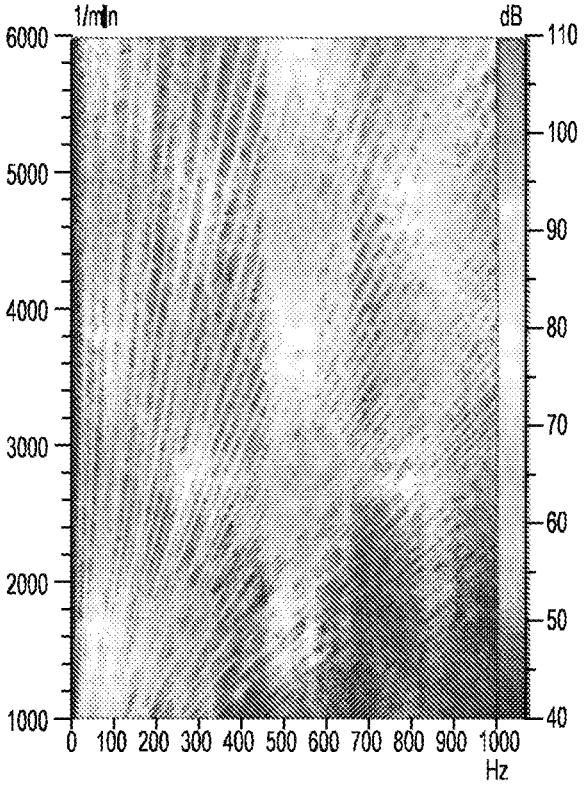
FIG. 8 is a graph showing the radiated noise level and the frequency range of the radiated noise emitted by a device according to the invention.

In addition, as shown in FIG. 7, an air intake hose having only one porous element, does not allow the absorption of the radiated noises over a wide frequency range. Thus, in the example herein described, the air intake hose does not allow absorbing the sound emissions around 500 Hz. On the other hand, it can be noted on the graph presented in FIG. 8 that the device 1 according to the invention allows absorbing substantially all the sound frequencies of the emitted radiated noises.

Thus, the invention proposes a device 1 for attenuating suction noises and radiated noises allowing covering a wide range of frequencies, still without requiring a significant volume.

Of course, the invention is not limited to sole embodiments represented hereinabove, but it encompasses on the contrary all the embodiments.

The invention claimed is:

1. A device for attenuating suction noises and radiated noises, wherein the device comprises:

a gas delivery conduit configured to be connected to a combustion engine, the gas delivery conduit having a peripheral wall over at least one portion of which is disposed at least one air-porous element;

at least one tube disposed in the gas delivery conduit, at least one peripheral chamber disposed between the at least one tube and the peripheral wall of the gas delivery conduit, a plurality of transverse inner walls dividing the at least one peripheral chamber into a plurality of compartments, the at least one tube having a first portion, a second portion and a third portion;

the first portion of the at least one tube having at least three portions that have a plurality of orifices, each one of the at least three portions form with a respective one of the plurality of compartments an absorption silencer that is calibrated to attenuate a range of distinct frequencies;

the second portion of the at least one tube has an orifice and forms with a respective one of the plurality of compartments a resonator; and the third portion of the at least one tube has two diametrically opposed orifices that forms with a respective one of the plurality of compartments an expansion chamber for gas circulating in the at least one tube.

2. The device according to claim 1, wherein the at least one air-porous element has at least one strip of air-porous material.

3. The device according to claim 1, wherein the at least one air-porous element comprises at least two diametrically opposed air-porous elements.

* * * * *